United States Patent [19]

Bertrand

[11] 4,080,941

[45] Mar. 28, 1978

[54] DEVICE FOR RECYCLING THE EXHAUST GASES OF AN INTERNAL COMBUSTION ENGINE

[75] Inventor: Bernard Bertrand, Vernouillet, France

[73] Assignee: Automobiles Peugeot, Paris, France

[21] Appl. No.: 758,858

[22] Filed: Jan. 12, 1977

[30] Foreign Application Priority Data

Jan. 16, 1976 France ..... 76 01047

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 2,154,417 | 4/1939 | Anderson | 123/119 A |
| 2,543,194 | 2/1951 | Paris | 123/119 A |
| 2,722,927 | 11/1955 | Cornelius | 123/119 A |
| 3,738,342 | 6/1973 | Lewakowski | 123/119 A |
| 3,842,814 | 10/1974 | Bier | 123/119 A |

*Primary Examiner*—Charles J. Myhre
*Assistant Examiner*—William Randolph
*Attorney, Agent, or Firm*—Burns, Doane, Swecker & Mathis

[57] ABSTRACT

The device comprises a recycling passage interconnecting the induction pipe and exhaust pipe of the engine. A valve for regulating the flow in the passage is controlled by the movable wall of a suction capsule. The inside of the capsule communicates with a suction take-off orifice in the induction pipe by way of a pipe in which there is inserted a chamber of a suction regulator. An opening in the chamber puts the latter in communication with the atmosphere and the opening cooperates with a valve member connected to a movable wall of the chamber. A spring connects the outside of the movable wall of the chamber to a mechanism controlling the butterfly valve member in such manner that the return force of the spring varies in the same direction as the opening of the butterfly valve member.

5 Claims, 1 Drawing Figure

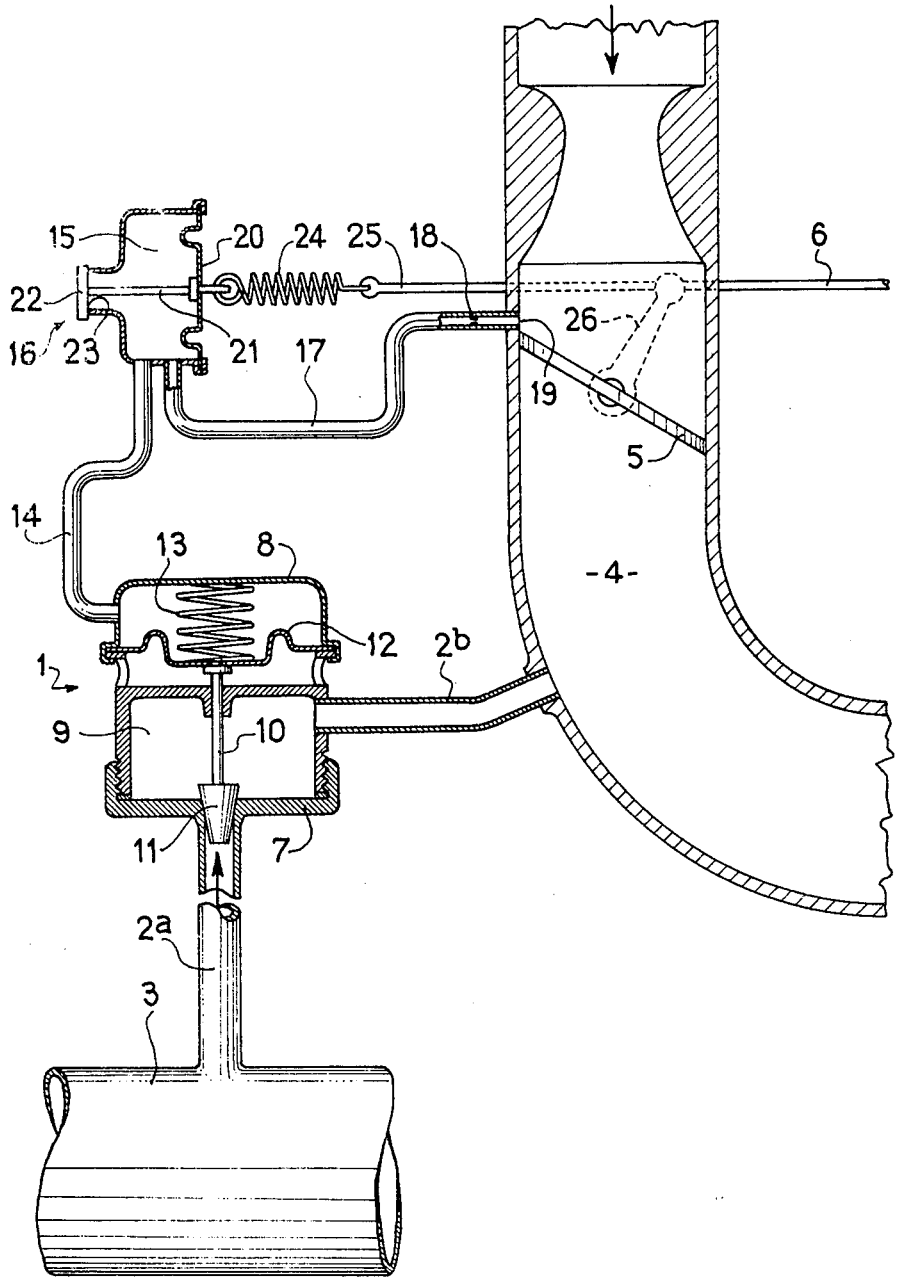
15
20
24
25
18
6
22
16
23
21
17
26
19
5
14
13
8
-4-
12
2b
1
9
10
11
7
2a
3

DEVICE FOR RECYCLING THE EXHAUST GASES OF AN INTERNAL COMBUSTION ENGINE

The invention relates to an internal combustion engine and more particularly a device for regulating the flow of the exhaust gas reintroduced into the induction pipe as a function of the conditions of utilization of the engine.

It is known that nitrogen oxides are among the polluting agents emitted by the exhaust gases of internal combustion engines. It is also known that in recycling a part of the exhaust gases in order to mix them with the fresh gases arriving in the induction pipe of the engine, the temperature of combustion in the combustion chambers is reduced. This has for effect to reduce the formation of these nitrogen oxides and consequently the emission thereof in the exhaust gases.

It is generally acknowledged that the recycling of the exhaust gases into the induction pipe is essential only during the utilization of the engine under a partial load, corresponding to a large formation of nitrogen oxides, whereas such a recycling is practically unnecessary at idling speed and at full load when it has even the drawback of resulting in a certain loss of engine power.

Devices are known for controlling the recycling of exhaust gases which employ a closure device, termed a regulating valve, interposed in the recycling circuit between the exhaust pipe and the induction pipe. The extent of opening is governed by a suction capsule controlled by the suction prevailing in the main induction pipe of the engine.

In a first arrangement, the means for taking off the suction comprise at least one orifice formed in the main induction pipe very slightly upstream of the adjustable gas throttling means so that when the latter is in its closing position, that is to say, corresponding to idling speed, the suction take-off orifice is subjected to atmospheric pressure. In this way, the suction capsule is only subjected to suction in respect of intermediate positions of the throttling means, the suction becoming too low in the opening position of the throttling means, that is to say, at full load, to act on the diaphragm of the capsule.

The main drawback of these known devices is that they result in a recycling rate which decreases with increase in the filling of the cylinders, whereas the temperature in the combustion chambers, and consequently the formation of nitrogen oxide, increase with increase in this filling.

In another device, the position of the means regulating the amount of recycling gas is directly related to the position of the throttling means of the induction pipe which permits maintaining a constant recycling rate, irrespective of the speed of the engine, throughout the range of utilization under partial load in respect of which recycling is required. Unfortunately, the direct control of the regulating device of the throttling means of the induction pipe results in a stiffening of the accelerator pedal and renders the driving of the vehicle supplied with the engine particularly tiring.

The invention relates to a device of the type comprising a valve for regulating the flow of the recycled gases, interposed in the recycling circuit between an exhaust pipe and an induction pipe, said valve being shifted by a suction capsule connected to a suction take-off disposed in the induction pipe of the engine and controlled by a suction regulator.

In a known arrangement of this type (U.S. Pat. No. 3,842,814), the suction to which the suction capsule acting on the recycling valve is subjected is regulated by means of a jet of variable section the moving part of which jet is directly positioned by the spindle of the gas throttling butterfly valve member. Now, in order that such a jet be precise, it must have large dimensions which results in a correspondingly large consumption of vacuum and requires the presence of a vacuum reserve of large volume. Moreover, such a jet is liable to clog and this adversely affects the fidelity with time.

An object of the present invention is to provide by simple means, with a low consumption of vacuum and with no reserve of vacuum, a more precise regulation of higher fidelity which achieves a proportionality between the flow of fresh gas and the flow of recycled gas.

This is achieved in arranging that the suction regulator comprise a chamber communicating with the pipe connecting the induction pipe to the suction capsule, said chamber having an opening for putting it in communication with the atmosphere, with which opening there is associated a valve member which is connected to a moving wall on which the suction acts in opposition to the force exerted by a return spring, which latter is connected to a mechanism controlling the butterfly valve member so that its return force varies in the same direction as the opening of the butterfly valve member.

An embodiment will be described in the ensuing description with reference to the single FIGURE which shows diagrammatically an improved device for recycling gases according to the invention.

This FIGURE shows a closure device 1 for regulating the flow of the recycled gases and termed a regulating valve. This valve is interposed between a pipe **2*a* leading from an exhaust pipe 3 and a pipe 2*b* leading to an induction pipe 4**.

The gas flow in the induction pipe 4 is controlled by a butterfly valve member 5 which is connected by conventional means 6 to an accelerator pedal (not shown).

The regulating valve 1, which is of known type, mainly comprises a body 7 on which a suction capsule 8 is adapted. The body 7 defines a chamber 9 into which the two pipes **2*a* and 2*b* open out. A wall of this chamber constitutes a bearing for guiding a rod 10 which carries at one end a valve member 11 which governs the section of the passage through the pipe 2*a*. The other end of the rod 10 is secured to a flexible diaphragm 12 which constitutes a movable wall of the capsule 8. A spring 13 biases the diaphragm 12 in a direction to cause the valve member 11 to close the pipe 2*a***.

The capsule 8 is connected through a pipe 14 to a chamber 15 of a suction regulator 16. Leading from the chamber 15 is a pipe 17 having a calibrated orifice 18 and opening into the induction pipe 4 by way of orifice 19. As can be seen in the FIGURE, this orifice 19 is located very slightly upstream of the valve member 5 when the latter is in the closing position.

The chamber 15 of the regulator 16 comprises a movable wall 20 which is connected by a rod 21 to a valve member 22 which closes an orifice 23 for putting the chamber 15 in communication with the atmosphere. The valve member 22 has a large cross section relative to the cross section of the calibrated orifice 18. The movable wall 20 is connected, through a spring 24 and a rod 25, to a lever 26 which is integral with the spindle of the gas throttling butterfly member 5, so that the tension of the spring 24 increases when the butterfly valve member opens the induction pipe. This spring 24 tends to pull the wall 20 in the direction for causing the valve member 22 to close the orifice 23 and it preferably exerts a force substantially lower than that exerted by a normal return spring for the butterfly valve member 5. This normal spring is not shown in the drawing.

The device just described operates in the following manner:

When the engine operates at idling speed, the butterfly valve member 5 is closed and the orifice 19 located above the latter is subjected to atmospheric pressure. No suction can therefore reach the capsule 8 and the valve member 11 closes the pipe *2a*. No recycling occurs.

When the engine operates under a partial load, the butterfly valve member 5 partially opens the induction pipe and the orifice 19 is subjected to the suction of the induction pipe 4. The diaphragm 20 is then drawn in, in opposition to the action of the return spring 24, and this shifts the valve member 22 away from its seat and produces a leakage which permits a regulation of the suction in the chamber 15 at a value which is a function of the tension of the spring 24 and consequently of the extent of the opening of the butterfly member 5.

This regulated suction is transmitted to the capsule 8 and has for effect to open the valve member 11 to an extent which increases with the opening of the butterfly valve member 5.

Consequently, it will be understood that the position of the valve member 11, and therefore the section of the passage through the pipe *2a*, depends on the position of the butterfly valve member 5 and this is achieved without any notable stiffening of the accelerator pedal. Indeed, the movable wall 20 of the regulator 16 may be of small size so that the spring 24 may have a very small action with respect to the force exerted by the normal return spring for the butterfly valve member 5 and it is even possible to reduce the force exerted by the latter spring in order to take into account the force exerted by the spring 24.

When the engine operates under full load, the suction in the region of the orifice 19 becomes very low and it is then insufficient to shift the diaphragm 12 of the capsule 8, the valve member 11 remaining closed.

It will be understood that the invention is also applicable to other known types of regulating valve without departing from the scope of the invention.

Thus, in particular, there may be employed a flow regulating apparatus according to any one of the claims of the first Certificate of Addition No. 70 36,959 of French Pat. No. 1,564,590.

Having now described my invention what I claim as new and desire to secure by Letters Patent is:

1. A device for recycling the exhaust gases of an internal combustion engine comprising an exhaust pipe of the engine, an induction pipe of the engine, a butterfly valve member in the induction pipe, a recycling passage putting the exhaust pipe in communication with the induction pipe, a valve for regulating the flow of the recycled gases and interposed in the recycling passage, between the exhaust pipe and the induction pipe, a suction take off orifice defined in the induction pipe of the engine, a suction capsule, a pipeline connecting the suction orifice to the suction capsule, the capsule having a movable wall subjected on one face to suction inside the capsule and on an opposite face to atmospheric pressure, said movable wall being connected to actuate said valve, a suction regulator comprising a chamber interposed in said pipeline, means defining an opening in the chamber for putting the chamber in communication with the atmosphere, a valve member cooperative with said opening, said chamber including a movable wall on which suction in the chamber acts, said movable wall operatively connected to said valve member, a mechanism connected to shift the butterfly valve member, a return spring connected to the mechanism at one end and to the movable wall of the chamber at an opposite end of the spring, the movable wall of the chamber being subjected to the suction in the chamber on one face and to the force exerted by said spring on an opposite face, the arrangement being such that the return force exerted by the spring increases with the opening of the butterfly valve member.

2. A device as claimed in claim 1, wherein the pipe connecting the chamber to the induction pipe has a calibrated orifice of small section.

3. A device as claimed in claim 2, wherein the opening of the chamber has a cross section which is substantially larger than that of the calibrated orifice.

4. A device as claimed in claim 1, wherein a second return spring is connected to the butterfly valve member and the force exerted by the first mentioned return spring connected to the movable wall of the chamber is small relative to the force exerted by the second return spring connected to the butterfly valve member.

5. A device as claimed in claim 1, wherein the suction take off is located slightly upstream of the butterfly valve member when the latter is in an induction pipe closing position.

* * * * *